US011419398B2

(12) United States Patent
Harris

(10) Patent No.: US 11,419,398 B2
(45) Date of Patent: Aug. 23, 2022

(54) MEDICINE ORGANIZER BAG

(71) Applicant: Frederick Harris, Moreland Hills, OH (US)

(72) Inventor: Frederick Harris, Moreland Hills, OH (US)

( * ) Notice: Subject to any disclaimer, the term of this patent is extended or adjusted under 35 U.S.C. 154(b) by 393 days.

(21) Appl. No.: 16/783,462

(22) Filed: Feb. 6, 2020

(65) Prior Publication Data

US 2021/0244148 A1 Aug. 12, 2021

(51) Int. Cl.

| | |
|---|---|
| ***A45F 3/00*** | (2006.01) |
| ***A45C 13/02*** | (2006.01) |
| ***A45C 13/10*** | (2006.01) |
| ***A45C 11/00*** | (2006.01) |
| ***A61J 1/03*** | (2006.01) |
| ***A45C 3/02*** | (2006.01) |

(52) U.S. Cl.

CPC ..... *A45C 13/02* (2013.01); *A45C 3/02* (2013.01); *A45C 11/00* (2013.01); *A45C 13/103* (2013.01); *A45C 13/1092* (2013.01); *A61J 1/03* (2013.01); *A45C 2011/007* (2013.01); *A45C 2013/026* (2013.01)

(58) Field of Classification Search

CPC ..... A61J 2200/30; A61J 1/03; A45C 13/02; A45C 11/00; A45C 2011/033; A45C 2011/007; A45C 2013/026; A45C 3/02

USPC ..... 206/570, 534; 224/153

See application file for complete search history.

(56) References Cited

U.S. PATENT DOCUMENTS

| | | | | |
|---|---|---|---|---|
| 10,842,712 | B1 * | 11/2020 | Wingate, III | B65D 85/70 |
| 2013/0220850 | A1 * | 8/2013 | Wingate, III | A45C 11/00 206/223 |
| 2016/0143807 | A1 * | 5/2016 | Ika | A61J 7/0069 206/216 |
| 2016/0158108 | A1 * | 6/2016 | Gofer | A61J 1/035 206/539 |

* cited by examiner

*Primary Examiner* — King M Chu

(74) *Attorney, Agent, or Firm* — Daniel M. Cohn; Howard M. Cohn

(57) ABSTRACT

Herein is a complete medical care system utilizing a medicine organizer bag containing a diverse assortment of OTC medicines (akin to a pharmacy). The medicine organizer bag is used in conjunction with an instructional App and website that navigates one to the proper medicine based on a person's symptoms and utilizing manufacturer's product information or virtual physician link to address common illnesses. The briefcase formed of first and second sections defining an interior volume and closed with a flap. The interior volume is closed by a zippered securement. A first interior wall is disposed within the first section, and a second interior wall disposed within the second section, each containing medicine holders. The plurality of medicine holders each includes an identifier. A third interior wall is adjacent to the first interior wall within the flap. A removable interior detachable travel component is adapted to be removably secured within the briefcase.

20 Claims, 11 Drawing Sheets

MEDICINE ORGANIZER BAG

TECHNICAL FIELD OF THE INVENTION

The present invention relates to a medicine organizer bag, and more particularly to a medicine organizer bag containing an on-demand, self-directing complete care system used in conjunction with a computer application.

BACKGROUND OF THE INVENTION

First-aid kits generally contain items intended to be used as a means to quickly and effectively respond to accidents or injuries when away from traditional medical emergency facilities. Such kits are intended to be used either by the injured party or to aid someone else who has been injured. To be effective therefore, a first-aid kit must be lightweight, portable, accessible, and must contain the necessary equipment to treat accidents or injuries that may occur based on the situation and environment. A person must become aware of and be able to purchase the products that are necessary to complete the recovery process at home.

Organizing, storing and efficiently carrying medication can be a cumbersome task requiring diligence from the individual. Self-administered medication requires a careful eye for correct dosages and medication, requires taking proper measures to adequately store the medication, and further requires the user to take the medication on the correct schedule and thus have it immediately accessible if necessary. Unfortunately, there are numerous instances in which medication is misused with harmful and sometimes fatal results. Misuse may involve a variety of different factors, such as taking the correct medication in an improper manner; taking the correct medication for the improper or non-indicated condition; taking the medication for a non-indicated condition; and taking the medicine at an incorrect time or on an incorrect time schedule with respect to meals. Misuse also take place when taking the incorrect medication resulting from similarities between the shape, size, name and/or color of different medication in the bottles, packets or containers in which different medications are dispensed.

SUMMARY OF THE INVENTION

According to an embodiment of the present invention, there is disclosed a medicine organizer bag consisting of a diverse assortment of medicines accompanied with an on-demand, self-directing complete care system used in conjunction with a computer application. The medicine organizer bag is formed of a briefcase which contains one or more medicine holders and the assortment of medicines disposed therein. The briefcase formed of first and second sections defining an interior volume and closed with a flap. The interior volume of the briefcase is closed by a zippered securement along the perimeter of the first and second sections. A first interior wall is disposed within the first section, and a second interior wall disposed within the second section, each of which contain one or more medicine holders. The plurality of medicine holders each include an identifier corresponding to a specific medicine class. A third interior wall is adjacent to the first interior wall within the flap. A removable interior detachable travel component is adapted to be removably secured within the briefcase, the interior detachable travel component having first and second medicine walls, each containing the one or more medicine holders.

According to an embodiment of the present invention, there is disclosed a medicine organizer bag consisting of a diverse assortment of medicines containing an on-demand, self-directing complete care system used in conjunction with a computer application to aide in selection of proper medication based on a person's symptoms. The medicine organizer bag is formed of a briefcase which contains one or more medicine holders and the assortment of medicines disposed therein. The briefcase is formed of first and second sections defining an interior volume and closed with a flap having a buckle and handle element disposed thereupon. The interior volume of the briefcase is closed by a zippered securement along the perimeter of the first and second sections. A first interior wall is disposed within the first section, and a second interior wall disposed within the second section, each of which contain the one or more medicine holders. The plurality of medicine holders each include an identifier corresponding to a specific medicine. A third interior wall includes a pocket and a mirror, adjacent to the first interior wall within the flap. A removable interior detachable travel component having attachment means is adapted to be removably secured to a corresponding attachment element within the briefcase, the interior detachable travel component having first and second medicine walls, each containing the one or more medicine holders.

BRIEF DESCRIPTION OF THE DRAWINGS

The structure, operation, and advantages of the present invention will become further apparent upon consideration of the following description taken in conjunction with the accompanying figures (FIGS.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
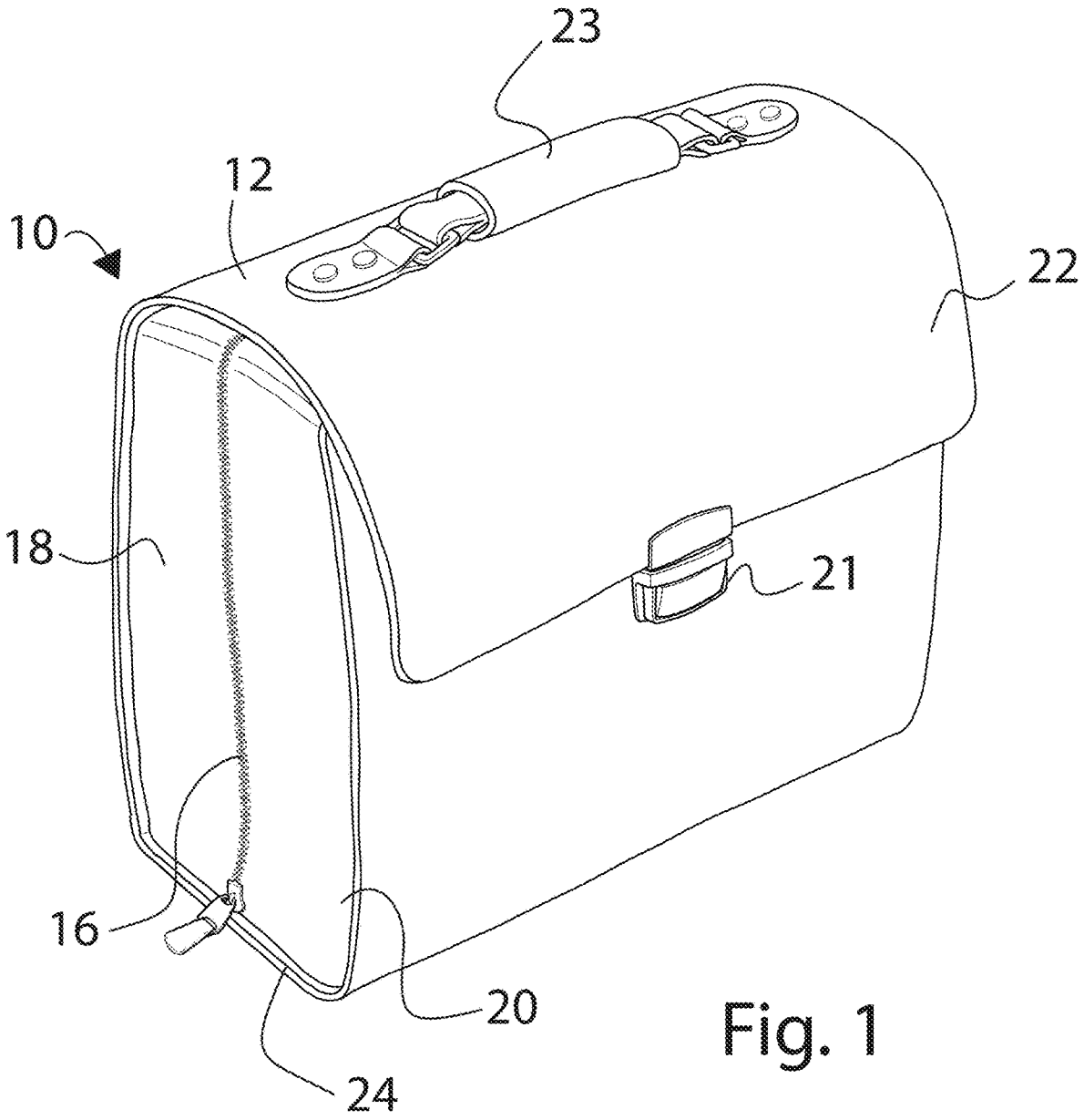
FIG. 1 is a front, three-dimensional view of the exterior of the medicine organizer bag, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

It would be highly advantageous to provide a medicine organizer bag which was adapted for use in a wide variety of different types of urgent medical situations. Such an organizer bag would also appeal to a diversity of users by ease in selection and proper usage of the medicines with the instructions. Such an organizer bag would also enable the user to replenish the medicines after an urgent medical situation is encountered without the need to buy a new organizer bag. Such an organizer bag would provide quick access to the appropriate medical product for a given type of urgent medical condition. Such an organizer bag would further provide quick access to authoritative information regarding different urgent medical situations or illnesses, so that the users could appropriate and properly use the medicines found in the organizer bag.

The medicine organizer bag 10 is an all-inclusive, over-the-counter (OTC) medicine bag, accompanied with an on-demand, self-directing complete care system consisting of a plurality of OTC medicines. The medicine organizer bag 10 is used in conjunction with a computer application (APP) designed for a mobile device (such as a smartphone), and an interactive website, which provides directions for immediate use of the medicine contained in the medicine organizer bag 10 for specific symptoms. The OTC medicines carried in the medicine organizer bag 10 has been selected for the most common illnesses that may arise at home, school, work or while traveling. The smart phone App and interactive web site allows one to enter medical symptoms so as to utilize its search engine, informative articles, and manufacturers' published product information to educate and assist the consumer in selecting the appropriate OTC product to use. The medicine organizer bag comes with a subscription plan via way of scanning QR codes within the medicine organizer bag 10 to replenish one's supply of medicine when the OTC product is running low or depleted.

The medicine organizer bag 10 is designed to be a complete traveling pharmacy and medical care system with an array of nonprescription remedies designed for various illnesses. The various medicines 12 within the medicine organizer bag 10 are categorically organized in sections akin to a pharmacy to be easily accessed.

As illustrated in FIG. 1, the medicine organizer bag 10 consists of a briefcase 12, which contains one or more medicine holders 30 and an assortment of medicines 31, secured within the interior volume 13. The assortment of medicines 31 may include tubes, packets, boxes, and any other packaging of medicine. The interior volume 13 includes a plurality of features for efficiently organizing medication, whereby a user is capable of rapidly locating and accessing the items from within the briefcase 12. The interior volume 13 is securely closed by a zippered securement means 16 along the perimeter of first and second sections 18 and 20, along with flap 22 form the briefcase 12 structure. A buckle 21 is disposed on the exterior of the briefcase 12 to secure the flap 22 to the second section 20 of the briefcase when it is closed. It is within the terms of the embodiment that a second zipper provides for an expansion chamber that extends the base 24 of the briefcase 12 for increased carrying capacity.

The briefcase 12 is preferably waterproof and has exemplary dimensions of a height of 11 inches, a width of 6 inches, and a length of 12.75 inches. A handle element 23 is disposed on the top of flap 22 to provide a means of conveniently carrying the briefcase 12.

Figure 2:
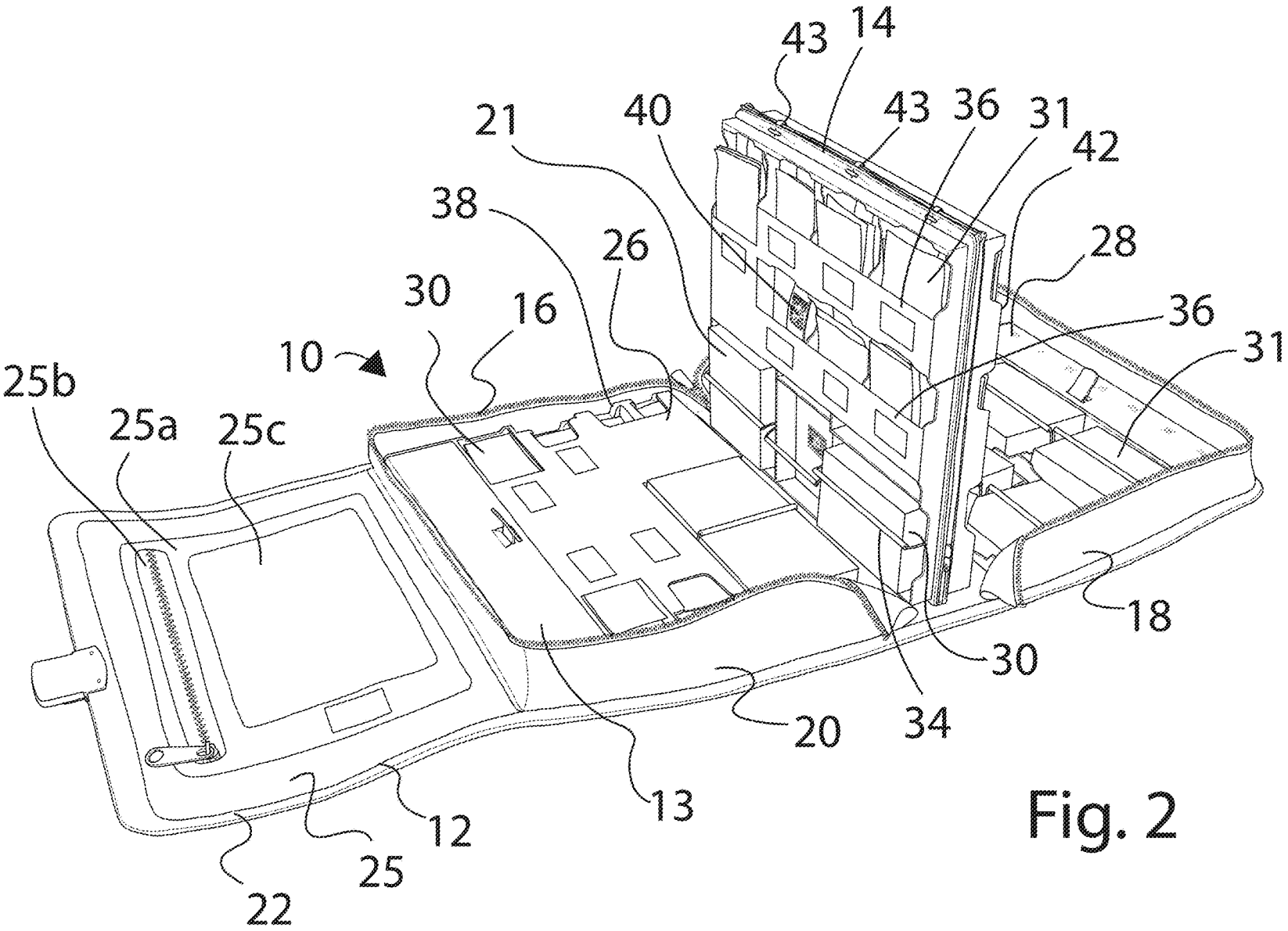
FIG. 2 is a front, three-dimensional view of the interior of the medicine organizer bag, in accordance with the present invention.
Figure 3:
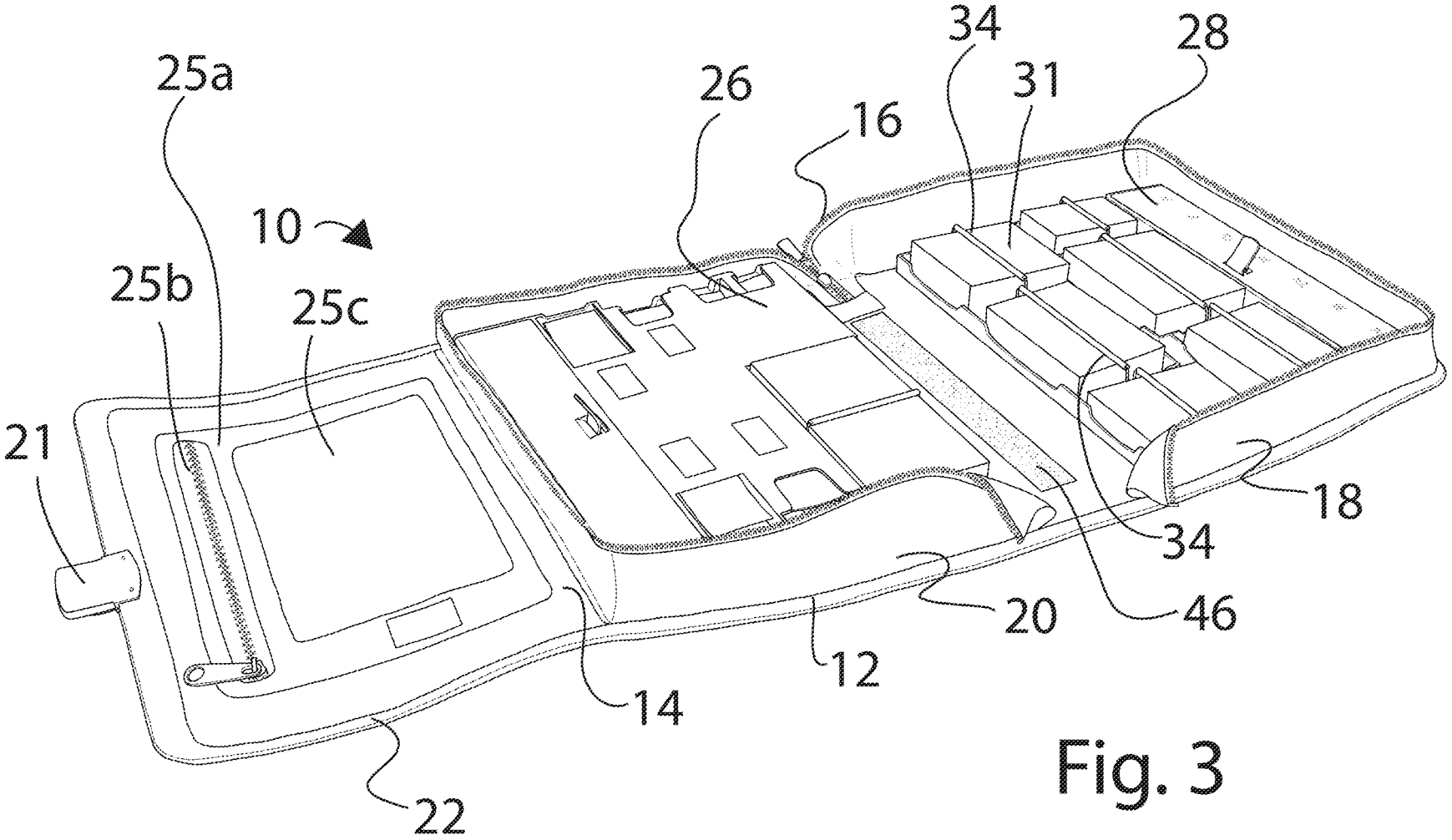
FIG. 3 is a front, three-dimensional view of the interior of the medicine organizer bag without the detachable travel component, in accordance with the present invention.

FIG. 2 illustrates an interior view of the medicine organizer bag 10. There are first and second interior walls 26 and 28, each of which contain a plurality of medicine holders 30. The first interior wall 26 is disposed within the first section 18, and the second interior wall 28 is disposed within the second section 20. A third interior wall 25 is adjacent to the first interior wall 26, within the flap 22. There may be a pocket 25*a* having a zipper closure 25*b* disposed within the third interior wall 25, and a mirror 25*c* mounted directly to the third interior wall.

Figure 10:
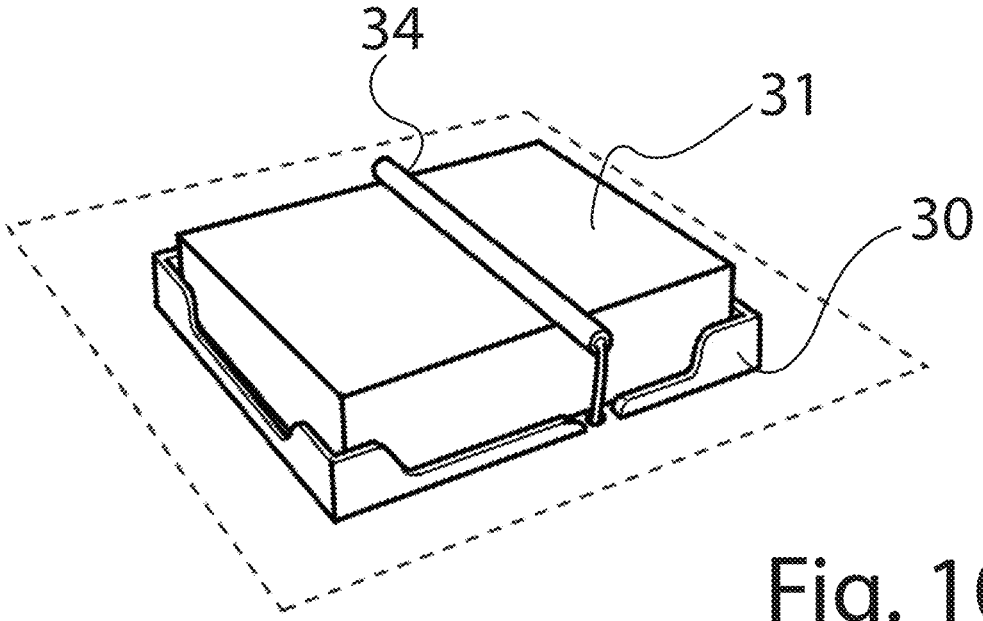
FIG. 10 is a front, three-dimensional view of a medicine holder of the detachable travel component having a box of medicine secured therein, in accordance with the present invention.

The plurality of medicine holders 30, as seen in FIG. 10, are attached to the first and second interior walls 26 and 28 in any desired fashion, such as with Velcro, riveting, and adhesive. The medicine holders 30 can include a variety of different configurations, such as roller secured box holders 34, spring-loaded packet holders 36, and drawers 38 which house medicine tubes with push through hole to grab tube and stop catches.

There may be any desired number of medicine holders 30, such as 11 rows of medicine holders, and 14 columns of medicine holders. Each of the medicine holders 30 is designed to accommodate a package of medicine 31. In a preferable embodiment, the medication 31 is spring loaded and stored in triplicate or more. As such, there may be a variety of different shapes and dimensions of medicine holders 30.

Figure 11:
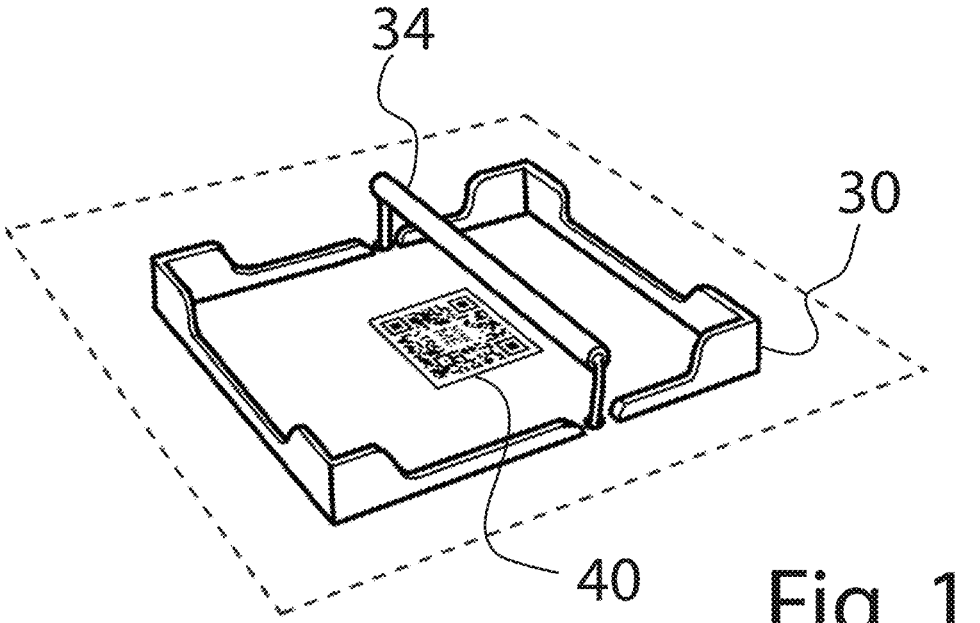
FIG. 11 is a front, three-dimensional view of a roller secured box holder of the detachable travel component, in accordance with the present invention.
Figure 12:
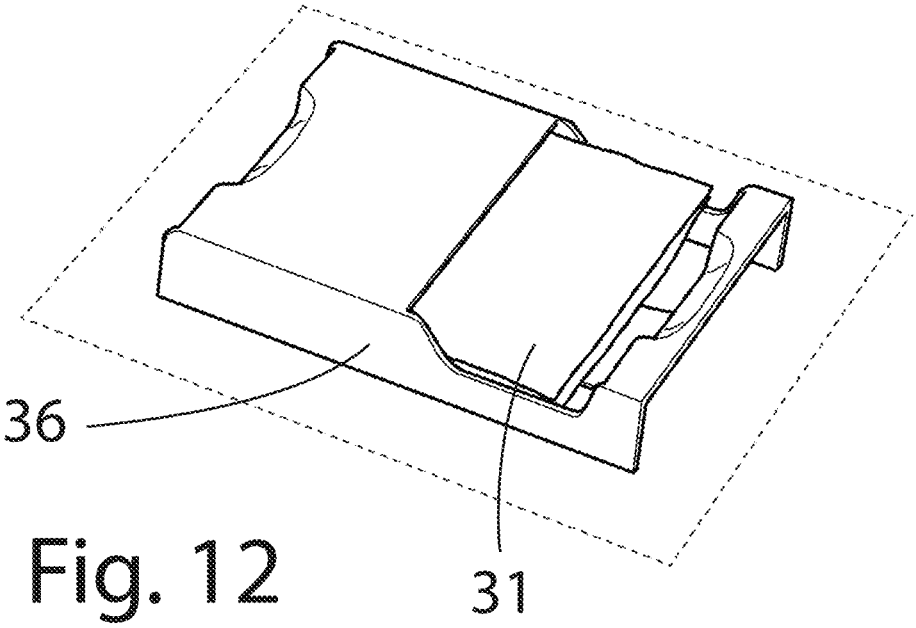
FIG. 12 is a front, three-dimensional view of a spring-loaded packet holder of the detachable travel component, in accordance with the present invention.
Figure 13:
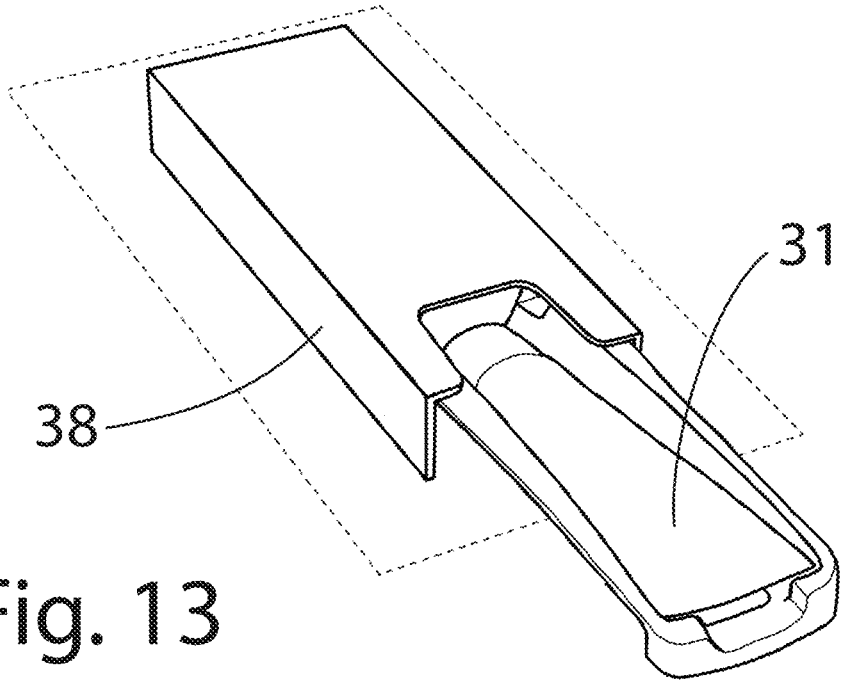
FIG. 13 is a front, three-dimensional view of a drawer, of the medicine organizer bag in accordance with the present invention.

Each of the medicine holders 30 includes an identifier, such as a QR code 40 as seen in FIG. 11, displayed thereon. The medicine 31 contained within the medicine holder 30 corresponds to the identifier. The QR codes 40 encoded on the medicine holder 30 become visible after the last packet of medicine 31 has been removed and can be easily scanned for product replenishment with a direct link to the replenishment website. As explained hereinafter, after the medicine 31 has been depleted, the user can simply scan the QR code 40, and an additional supply of the medicine will be sent to the user. Alternatively, one can reorder product via use of the App.

The medicine organizer bag 10 may contain any assortment and combination of desired medicine 31. For example, the briefcase 12 may include: Non-steroidal anti-inflammatory agents (NSAIDs) for headaches, muscles aches, sprains and strains; anti-diarrheal agents for diarrhea as well as travelers' diarrhea; stimulant and non-stimulant laxatives for constipation; antihistamines for allergies and itching; H2 blockers and Bismuth preparations for nausea, heartburn, indigestion, stomach upset and diarrhea; oral decongestants, cough suppressants and expectorants for sinus pressure, congestion, cold and flu relief; Fluticasone propionate nasal spray for allergies including nasal congestion, sneezing, itchy and watery eyes; Epinephrine inhaler for wheezing and shortness of breath; antimicrobial ointment for minor skin infections; anti-fungal cream for jock itch, athletes' foot and ringworm; low potency steroid cream for poison ivy, allergic and nonspecific dermatitis; vaginal anti-fungal cream for vaginal yeast infections; first aid items including antibiotic infused skin adhesives, cotton tipped swabs and emergency gel pads for burns, cuts and bruises; anesthetic hemorrhoid cream for hemorrhoids; sleep aides for restless nights and pain; dimenhydrinate, a special antihistamine used to treat nausea, vomiting and dizziness caused by motion sickness while traveling; eye care including eye drops for minor eye irritation and lid wipes along with an oral topical anesthetic gel for dental pain, cankers sores, cold sores and fever blisters; Bayer® Aspirin, Tylenol®, Advil®, Aleve® and Midol® for headaches, fevers, muscle aches, strains, sprains, menstrual cramps and arthralgias. The combination of medicines 31 are chosen for their efficacy and comprehensive utility in conquering frequently occurring illnesses or ailments such as upper respiratory and sinus illness, flus, asthma, headaches, allergies, diarrheal illness, constipation, superficial cuts and bruises, stomach aches and upset, headaches, sea and motion sickness, minor burns and rashes to describe some of the more common and urgent illness that one tends to face either at home, work, traveling, away overseas or at college.

The briefcase 12 includes an interior detachable travel component 14 that is designed to be removed from the briefcase for use in travel. The detachable travel component 14 may have any desired dimensions, such as for example, a height of 11 inches, a width of 6 inches, and a length of 12 inches. The detachable travel component 14 includes first and second walls 40 and 42, each of which contains a plurality of medicine holders 30.

Figure 4:
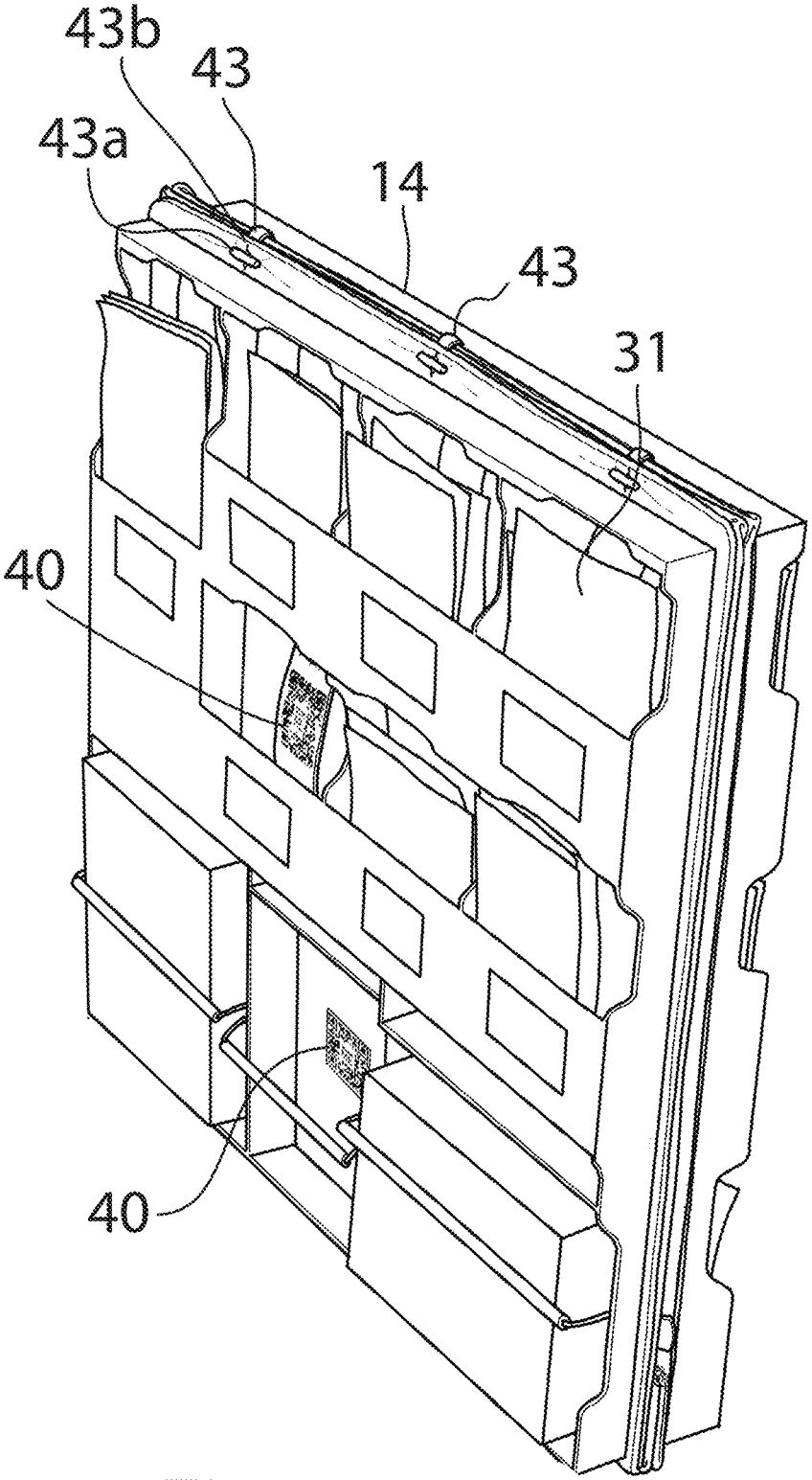
FIG. 4 is a front, three-dimensional view of a first orientation (top view) of the detachable travel component, in accordance with the present invention.

As illustrated in FIG. 4, the interior detachable travel component 14 contains attachment means 44 attached on a bottom portion 14*a*. Preferably, the attachment means 44 is one or more strips of Velcro 44, that is designed to attach to a corresponding attachment means 46, such as a strip of Velcro 46, disposed within the interior of the briefcase 12. The strip of Velcro 46 is disposed between the first and second interior walls 26 and 28. Thus, the interior detachable travel component 14 can be quickly and easily attached and removed from the interior of the briefcase 12, utilizing the corresponding Velcro strips 44 and 46.

The interior detachable travel component 14 generally has a first position and a second position. The travel component 14 is illustrated in a first position in FIGS. 2, 4, and 5. The first position of the travel component 14 allows the travel component to be temporarily secured within the interior of the briefcase 12. The strips of Velcro 44 on the bottom portion 14*a* of the travel component 14 are secured to the strip of Velcro 46 within the briefcase 12. In the first position, the first and second medicine walls 40 and 42 form the exterior walls of the travel component 14.

Figure 5:
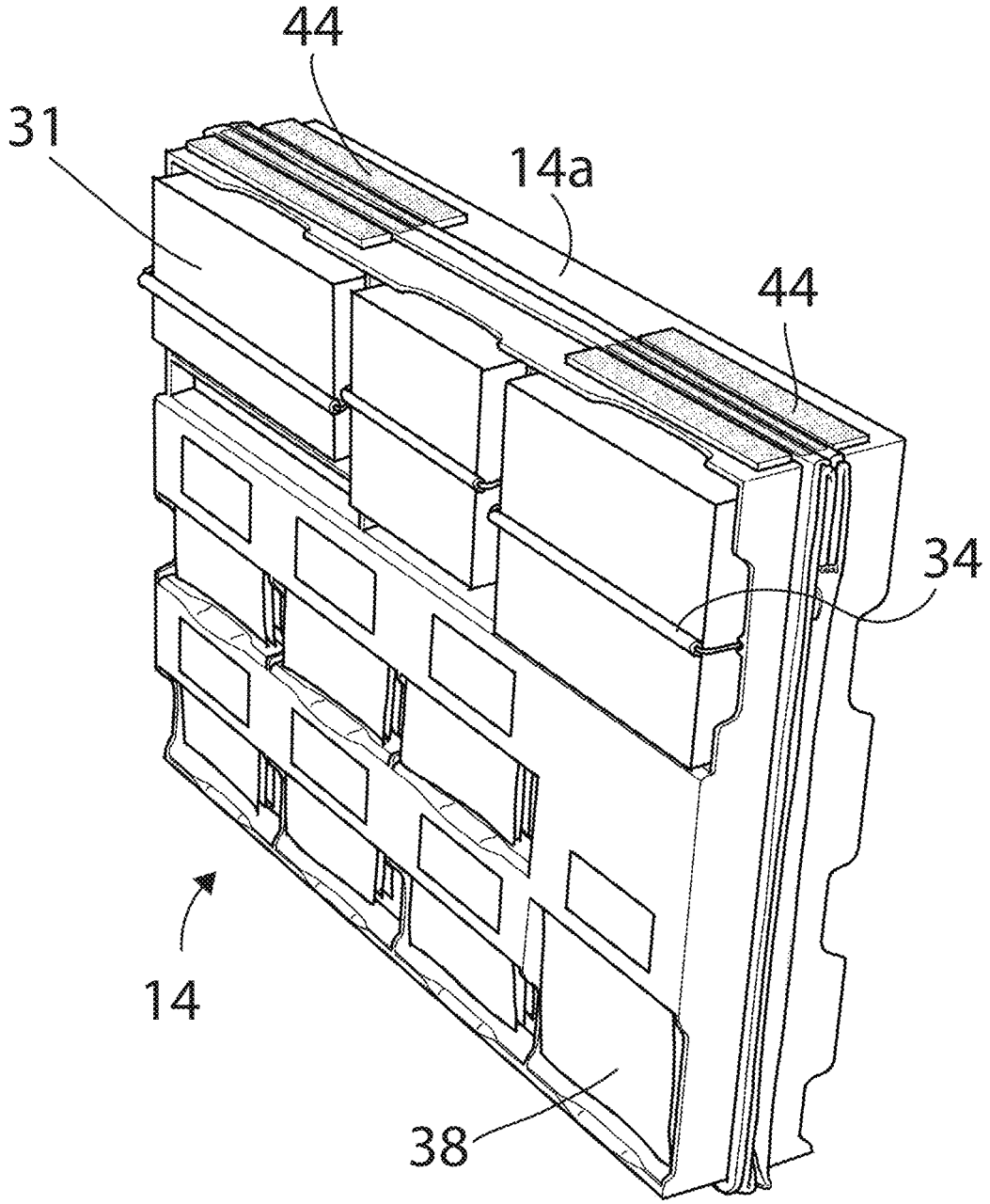
FIG. 5 is a front, three-dimensional view of FIG. 4 rotated 180 degrees (bottom now on top) orientation of the detachable travel component, in accordance with the present invention.

As seen in FIG. 5, the first and second medicine walls 40 and 42 are joined together with removable connectors 43. These connectors 43 may take any desired form, such as a hook 43*a* on the second medicine wall 42 secured within an opening 43*b* on the first medicine wall 40, although any desired connecting method may be utilized.

Figure 7:
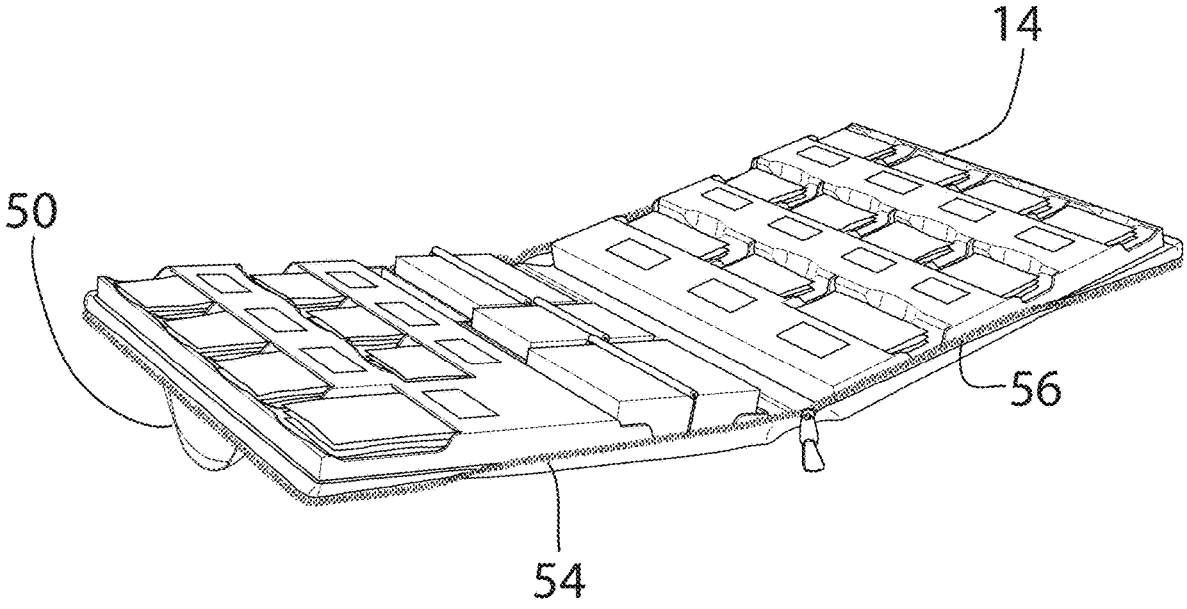
FIG. 7 is a front, three-dimensional open table top view of the transformation of the detachable travel component, in accordance with the present invention.
Figure 8:
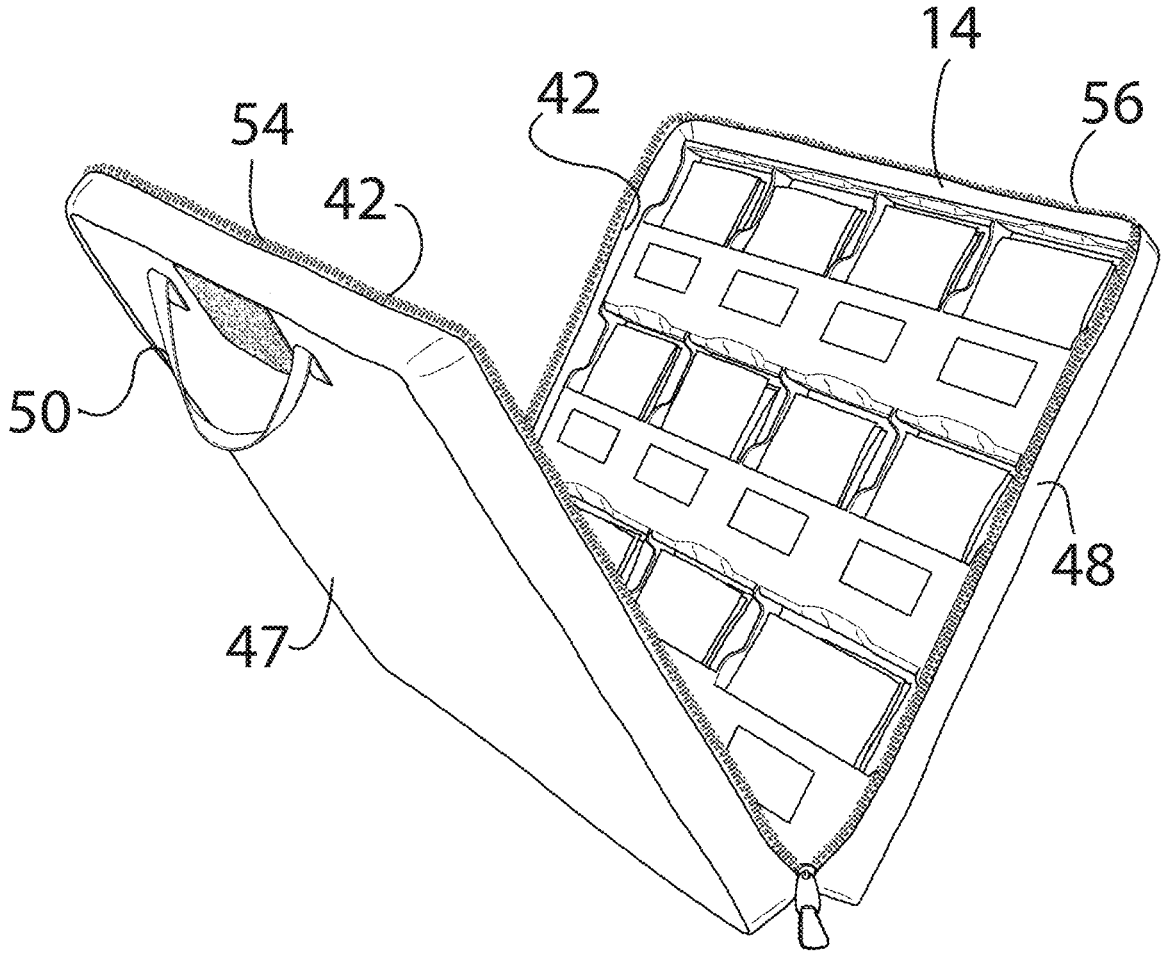
FIG. 8 is a front, three-dimensional view of the transformation of the detachable travel component, in accordance with the present invention.
Figure 9:
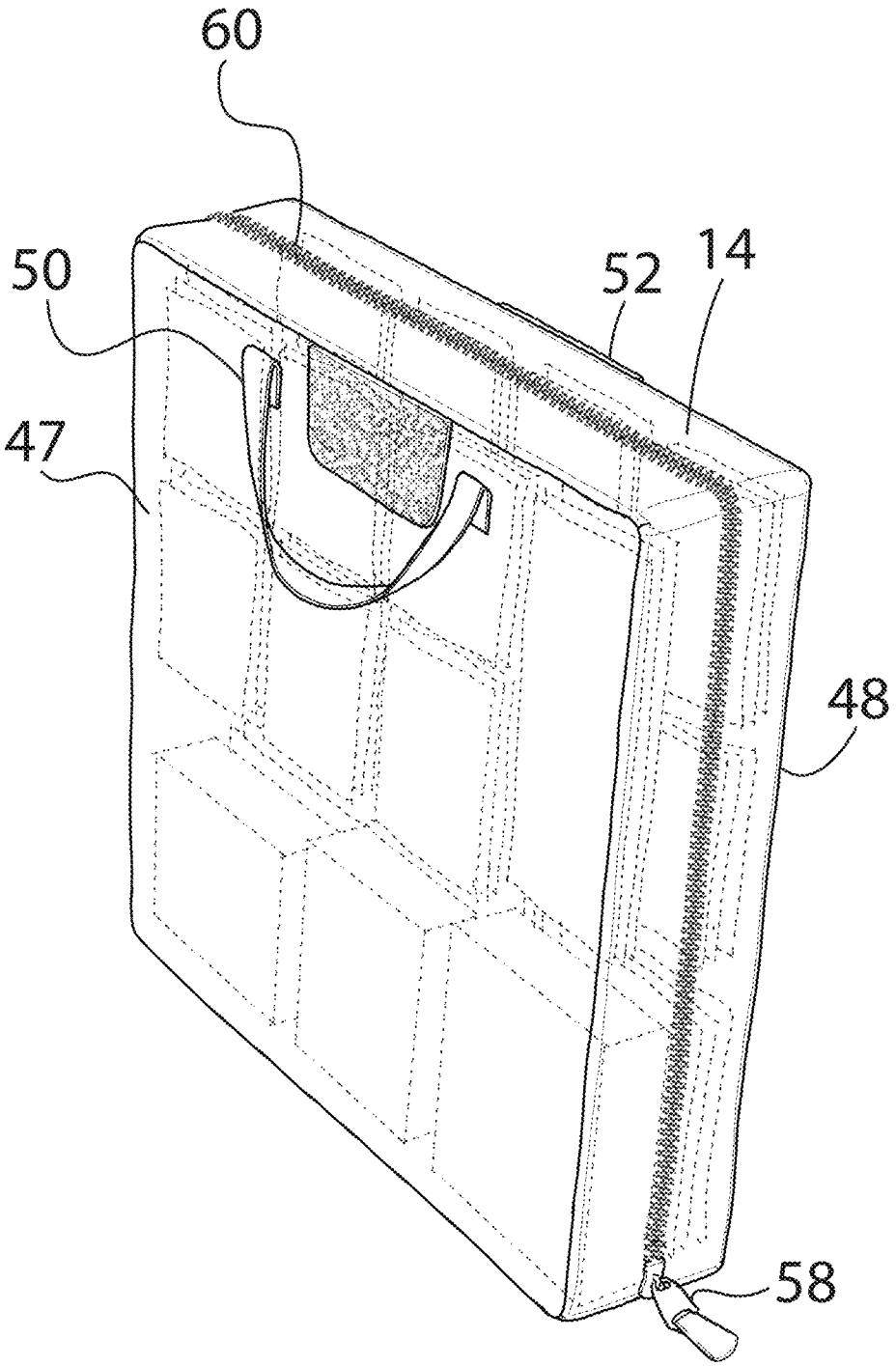
FIG. 9 is a front, three-dimensional view of a second orientation of the detachable travel component, in accordance with the present invention.

The travel component 14 is illustrated in a second position in FIGS. 4-9. The second position of the travel component 14 allows medicine 31 contained within the travel component to be safely secured. In the second position, the first and second medicine walls 40 and 42 form the interior walls of the travel component 14, and first and second outer walls 47 and 48 form the exterior walls of the travel component 14. The medicine 31 disposed upon the first and second medicine walls 40 and 42 is safely secured on the interior of the travel component 14. There are first and second handles 50 and 52 mounted to the first and second outer walls 47 and 48, respectively. The first and second outer walls 47 and 48 are secured together with first and second zipper strips 54 and 56, respectively, that are joined together with zipper handle to form the zipper structure 60, as seen in FIG. 9.

Figure 6:
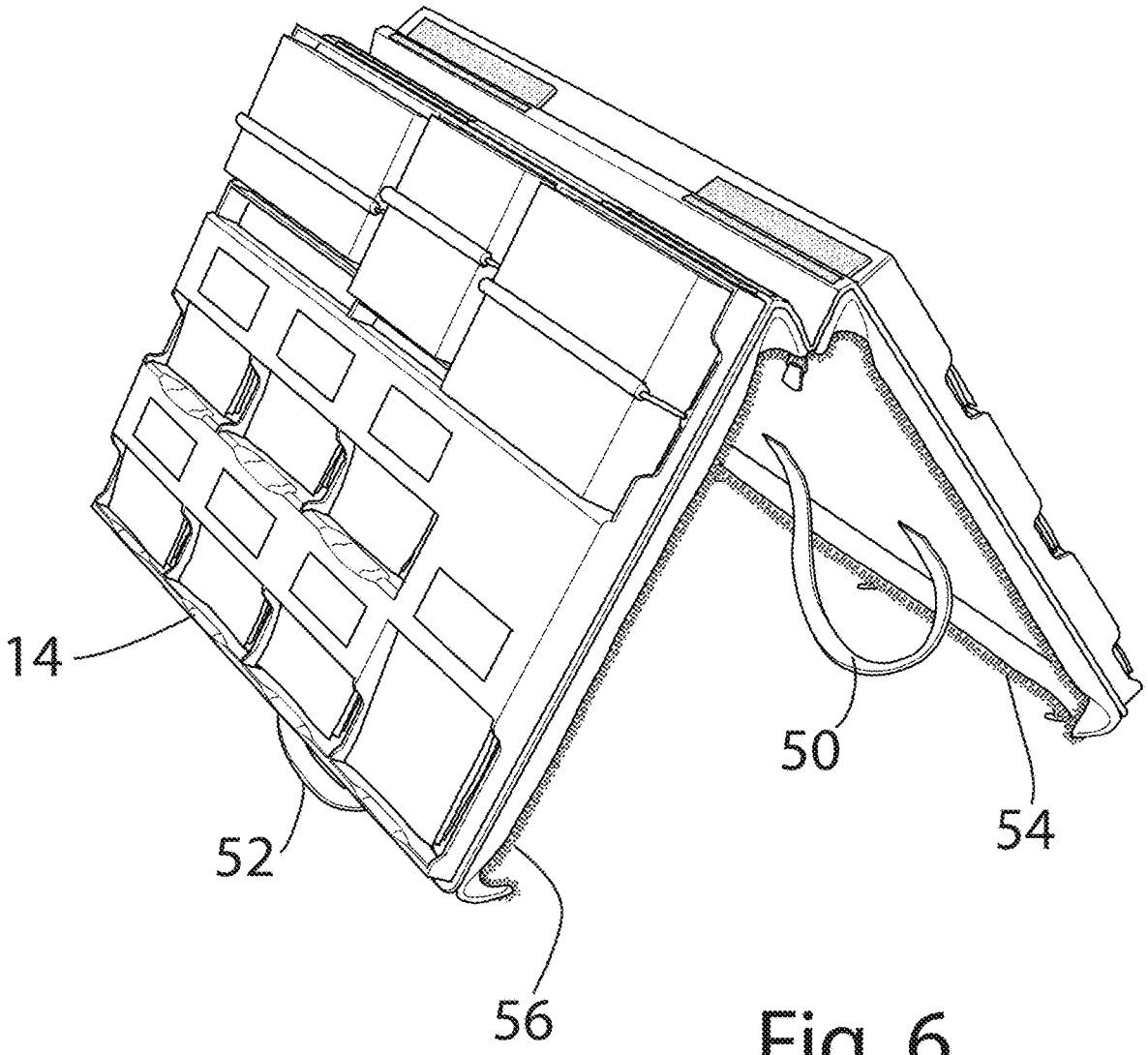
FIG. 6 is a front, three-dimensional view of the opening transformation of the detachable travel component, in accordance with the present invention.

FIGS. 6, 7, and 8 illustrate the transformation from the first position of the travel component 14 to the second position of the travel component. After the travel component 14 has been removed from the interior of the briefcase 12, the user unlatches the removable connectors 43, and turns the travel component 14 from the first position to the second position.

The medicine organizer bag 10 is designed to be used in conjunction with an App and/or website. The appropriate medicine 31 to take and corresponding treatment directions can be determined by a corresponding smart phone application and website based on the user's symptoms along with the manufacturers' product information and commercials matching the users' symptoms along with informative articles in the search by symptom section of the App or the blog section of the interconnected website. The App and website have a direct virtual link to qualified medical personnel who can be immediately consulted for a face to face consultation to evaluate or further direct care using this handy all inclusive "Doc in box", "virtual pharmacy", complete care system with medicine replenishment by website or subscription renewal.

When purchasing the medicine organizer bag 10, the user creates a profile within the App or website. The various medications, and other medical information relating to the user, is stored within a database. Further, the user enters his payment information to pay for the refills of depleted medication. It is within the terms of the embodiment that the user's medical team, such as his physician or Advanced Practice Provider, has access to the user's profile within the App or website.

As discussed hereinbefore, each of the medicine holders 30 includes an identifier, such as a QR code 40 as seen in FIG. 11, displayed thereon. The medicine 31 contained within the medicine holder 30 corresponds to the identifier. The QR codes 40 encoded on the medicine holder 30 become visible after the last packet of medicine 31 has been removed and can be easily scanned for replenishment with a direct link to the replenishment website. After the medicine 31 has been depleted, the user can simply scan the QR code 40, and an additional supply of the medicine can be ordered and sent to the user.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A medicine organizer bag containing an on-demand, self-directing complete care system used in conjunction with a computer application, consisting of a diverse assortment of OTC medicines, comprising;

a briefcase which contains one or more medicine holders and the assortment of medicines disposed therein;

the briefcase formed of first and second sections defining an interior volume and closed with a flap;

the interior volume of the briefcase closed by a zippered securement along the perimeter of the first and second sections;

a first interior wall disposed within the first section, and a second interior wall disposed within the second section, each of which contain the one or more medicine holders;

the plurality of medicine holders each including an identifier corresponding to a specific medicine;

a third interior wall adjacent to the first interior wall within the flap; and a removable interior detachable travel component adapted to be removably secured within the briefcase, the interior detachable travel component having first and second medicine walls, each containing the one or more medicine holders.

2. The medicine organizer bag of claim 1 further including a buckle disposed on the exterior of the briefcase to secure the flap to the second section of the briefcase.

3. The medicine organizer bag of claim 2 further including a handle element disposed on top of the flap for carrying the briefcase.

4. The medicine organizer bag of claim 3 further including a pocket having a zipper closure disposed within the third interior wall and a mirror mounted directly to the third interior wall.

5. The medicine organizer bag of claim 4 wherein the one or more medicine holders are attached to the briefcase by an attachment component selected from the group consisting of Velcro, rivets, and adhesives.

6. The medicine organizer bag of claim 5 wherein the one or more medicine holders can include a variety of different configurations selected from a group consisting of roller secured box holders, spring-loaded packet holders, and drawers which house tubes.

7. The medicine organizer bag of claim 6 wherein each of the one or more medicine holders includes a QR code that corresponds to the specific medicine contained therein such that when the medicine has been depleted, a user can scan the QR code to order an additional supply of the medicine.

8. The medicine organizer bag of claim 1 wherein the interior detachable travel component contains attachment means attached on a bottom portion for attaching the interior detachable travel component to the briefcase.

9. The medicine organizer bag of claim 8 wherein a corresponding attachment element is attached to the interior of the briefcase to connect to the attachment element attached on the bottom portion of the interior detachable travel component.

10. The medicine organizer bag of claim 9 wherein the interior detachable travel component is adapted to be disposed in both a first position and a second position.

11. The medicine organizer bag of claim 10 wherein the interior detachable travel component is in the first position, such that the interior detachable travel component is secured within the interior of the briefcase and the first and second medicine walls form exterior walls of the interior detachable travel component.

12. The medicine organizer bag of claim 11 wherein the first and second medicine walls are joined together with removable connectors, when the interior detachable travel component is in the first position.

13. The medicine organizer bag of claim 10 wherein the interior detachable travel component is in the second position, such that the interior detachable travel component is removed from the interior of the briefcase and the first and second medicine walls form interior walls of the travel component, and first and second outer walls form exterior walls of the travel component.

14. The medicine organizer bag of claim 13 wherein first and second outer walls are secured together with a zipper structure, and first and second handles are mounted to the first and second outer walls.

15. A medicine organizer bag containing an on-demand, self-directing complete care system used in conjunction with a computer application, consisting of an assortment of medicines, comprising;

a briefcase which contains one or more medicine holders and the assortment of medicines disposed therein;

the briefcase formed of first and second sections defining an interior volume and closed with a flap having a buckle and handle element disposed thereupon;

the interior volume of the briefcase closed by a zippered securement along the perimeter of the first and second sections;

a first interior wall disposed within the first section, and a second interior wall disposed within the second section, each of which contain the one or more medicine holders;

the plurality of medicine holders each including an identifier corresponding to a specific medicine;

a third interior wall including a pocket and a mirror, adjacent to the first interior wall within the flap; and a removable interior detachable travel component having attachment means adapted to be removably secured to a corresponding attachment element within the briefcase, the interior detachable travel component having first and second medicine walls, each containing the one or more medicine holders.

16. The medicine organizer bag of claim 15 wherein each of the one or more medicine holders includes a QR code that corresponds to the specific medicine contained therein such that when the medicine has been depleted, a user can scan the QR code to order an additional supply of the medicine.

17. The medicine organizer bag of claim 16 wherein the interior detachable travel component is adapted to be disposed in both a first position and a second position.

18. The medicine organizer bag of claim 15 wherein the interior detachable travel component is in the first position, such that the interior detachable travel component is secured within the interior of the briefcase and the first and second medicine walls form exterior walls of the interior detachable travel component.

19. The medicine organizer bag of claim 18 wherein the first and second medicine walls are joined together with removable connectors, when the interior detachable travel component is in the first position.

20. The medicine organizer bag of claim 15 wherein the interior detachable travel component is in the second position, such that the interior detachable travel component is removed from the interior of the briefcase and the first and second medicine walls form interior walls of the travel component, and first and second outer walls form exterior walls of the travel component.

* * * * *